US005839997A

United States Patent [19]

Roth et al.

[11] Patent Number: 5,839,997

[45] Date of Patent: Nov. 24, 1998

[54] WEIGHT-LIFTING APPARATUS AND METHOD

[75] Inventors: Mark R. Roth, Holly; Jon D. Schiff; Thomas M. Truran, both of St. Joseph, all of Mich.

[73] Assignee: Premise Group LLC, St. Joseph, Mich.

[21] Appl. No.: 10,863

[22] Filed: Jan. 22, 1998

[51] Int. Cl.[6] ..... A63B 21/075

[52] U.S. Cl. ..... 482/107; 482/108

[58] Field of Search ..... 482/50, 93, 94, 482/98, 99, 106, 107, 108, 109

[56] References Cited

U.S. PATENT DOCUMENTS

| | | | |
|---|---|---|---|
| 1,779,594 | 10/1930 | Hall . | |
| 3,771,785 | 11/1973 | Speyer . | |
| 3,825,253 | 7/1974 | Speyer . | |
| 3,913,908 | 10/1975 | Speyer . | |
| 4,453,710 | 6/1984 | Plotz . | |
| 4,529,197 | 7/1985 | Gogarty . | |
| 4,529,198 | 7/1985 | Hettick, Jr. . | |
| 4,787,629 | 11/1988 | DeMyer . | |
| 4,822,034 | 4/1989 | Shields . | |
| 4,971,305 | 11/1990 | Rennex . | |
| 4,982,957 | 1/1991 | Shields . | |
| 5,123,885 | 6/1992 | Shields . | |
| 5,344,375 | 9/1994 | Cooper . | |
| 5,435,800 | 7/1995 | Nelson | 482/108 |
| 5,637,064 | 6/1997 | Olson et al. . | |

FOREIGN PATENT DOCUMENTS

| | | |
|---|---|---|
| 1468902 | 2/1967 | France . |
| 1643024 | 7/1987 | U.S.S.R. . |
| 1780780 | 12/1992 | U.S.S.R. . |

*Primary Examiner*—John Mulcahy
*Attorney, Agent, or Firm*—Price, Heneveld, Cooper, DeWitt & Litton

[57] ABSTRACT

A weight-lifting apparatus includes a plurality of weights each having a central hole and a slot extending from the central hole to a perimeter of the associated weight, the slot having a width less than the diameter of the central hole. The apparatus further includes a shaft having opposing ends defining a diameter about equal to the central holes, and a sleeve positioned on the shaft. The shaft is shaped to rotatably engage the central holes and is rotatable to different positions. The shaft further has a plurality of recessed surfaces on the opposing ends corresponding to the different positions that extend different longitudinal lengths, the recessed surfaces defining with other surfaces on the shaft a reduced dimension about equal to the width of the slot. Further, the shaft and the weights are configured so that by rotating the shaft, the recessed surfaces are selectively positioned to allow the shaft to slide along one or more of the slots, thus selectively releasing the weights. A person using the weight-lifting apparatus can easily rotate the shaft to select a desired number of weights without interrupting their exercise routine.

19 Claims, 3 Drawing Sheets

"d"

WEIGHT-LIFTING APPARATUS AND METHOD

BACKGROUND OF THE INVENTION

The present invention pertains to weight-lifting apparatus and particularly to an apparatus having a self-contained mechanism for selecting and locking a plurality of weights to a bar.

Weight-lifting is a popular physical fitness activity for maintaining one's physical health and muscle tone, as evidenced by the large number of weight machines sold each year. Typically, the weight machines have a selectable total weight or force of resistance. However, the known weight machines tend to be bulky, expensive, difficult to maintain and are often cumbersome to operate. For example, often they include cables, pulleys, weight plates, and other mechanisms interconnected in complex arrangements to allow different exercises on a single machine. Commonly, the process of selecting the total weight or force of resistance requires the user to manipulate keys or pins in a way that detracts from the exercise itself.

As an alternative, some users lift free weights because, unlike known weight machines, free weights are less complicated, less expensive, allow a greater range of motion, and can be used in more/different exercises. Typically, free weights include a bar and a plurality of independent removable weights. The bar may be adapted for two-handed use or for single handed use, i.e., dumbbell use. In free weights, it is important to minimize the chance that the plates will slip off the ends of the bar. Accordingly, free weights require a secure retaining mechanism, such as a collar or a clip, for holding the plates on the bar. But such collars are often cumbersome to attach, and may be insecurely attached, particularly as they wear or become damaged such that manipulating them to a secure position is more difficult. Also, collars require that the weight lifter properly secure the collars in place, which may not always occur, particularly as the weight lifter becomes tired or distracted. Further, to assemble a particular weight to the bar, the user must transport the weights from a designated storage location to the bar (or vice versa) and then lift, align, slide and secure the weights onto the bar. This process is clumsy, cumbersome and requires time in addition to the time spent by the user in completing a weight-lifting workout. Many weight lifters become frustrated when particular weights cannot be found. Another problem is that having to store the individual plate weights at a separate storage location not only increases the time it takes to assemble the weights but inevitably leads to scattering the individual weights around the weight-lifting area. Finally, although weight-lifting is usually considered to be an anaerobic exercise (because one will typically take time to rest when changing weights between sets of exercises), some individuals like to use weight-lifting as part of an aerobic exercise. However, aerobic exercise requires nearly constant activity to maintain a sufficiently high heart rate. A person using free weights where weights must be retrieved, assembled onto a bar, and secured, cannot work out aerobically because an increased heart rate cannot be maintained when a person must take time to repeatedly retrieve, assemble and secure the weights.

As an alternative, some weights, typically dumbbells, are manufactured as one-piece articles having a predetermined weight, thus eliminating the need for individual weights and eliminating the need for collars. However, such dumbbells are often impractical because multiple sets of dumbbells are required if the user wishes to lift different weights during a workout. This is an expensive option that demands a large space for storing the weights. Further, the weight still must be transported from a storage location to a workout location.

The use of weights in physical therapy is becoming increasingly popular. It is important to physical therapists that they not be required to repeatedly assemble and secure weights onto bars. Further, workspace is often very valuable to physical therapists such that they need compact therapeutic equipment that does not take up a lot of space. Still further, many physical therapists require portable equipment that they can take with them to patients.

Therefore, an unfilled need exists for an adjustable weight-lifting apparatus that provides a range of weights that can be lifted, yet that is compact, self-contained and adapted for ease of use yet also for convenient storage and/or transport.

SUMMARY OF THE INVENTION

In one aspect of the invention, a weight-lifting apparatus includes a plurality of weights each having a central hole and a slot extending from the central hole to a perimeter of the associated weight, the slot having a width less than the diameter of the central hole. The apparatus further includes a bar including a rotatable shaft having opposing ends defining a diameter about equal to the central holes. The shaft is shaped to rotatably engage the central holes and is rotatable to different positions. The shaft further has a plurality of recessed surfaces on the opposing ends that extend different longitudinal lengths corresponding to the different positions, the recessed surfaces defining with other surfaces on the bar a reduced dimension about equal to the width of the slot. By rotating the shaft, the recessed surfaces are selectively positionable to allow the shaft to slide along one or more of the slots to selectively release the weights. In a narrower aspect, the apparatus also includes a holder for holding the weights while the weight is adjusted and for storing the unused weights while the apparatus is being used.

In another aspect of the invention, a method includes providing a weight-lifting apparatus having a plurality of weights and a shaft shaped to selectively engage one or more of the weights. The method further includes rotating the shaft to selectively engage a desired number of the weights, lifting the weight-lifting apparatus to perform an exercise, and repeating the steps of rotating and lifting as part of an aerobic exercise routine without stopping the aerobic exercise routine. In a narrower aspect, the method includes placing the weight in the holder and rotating the shaft to a position corresponding to the desired weight and removing the selected weight for lifting, thus allowing the weight to be changed with a minimum amount of time and effort.

Advantageously, a person using the present weight-lifting apparatus can rotate the shaft to select a desired number of weights, thus permitting the user to work out with a variety of weights with one self contained apparatus, and without requiring cumbersome collars or retainers to hold the weights. As a result, in addition to an anaerobic activity, a person using the instant weight-lifting apparatus may perform an aerobic workout because no time is wasted in retrieving or assembling the weights, i.e., nearly constant activity may be maintained. These and other features, advantages and objects of the present invention will be further understood and appreciated by those skilled in the art by reference to the following specification, claims and appended drawings.

DETAILED DESCRIPTION OF PREFERRED EMBODIMENT

Figures 1, 2, 3, 9, 10:
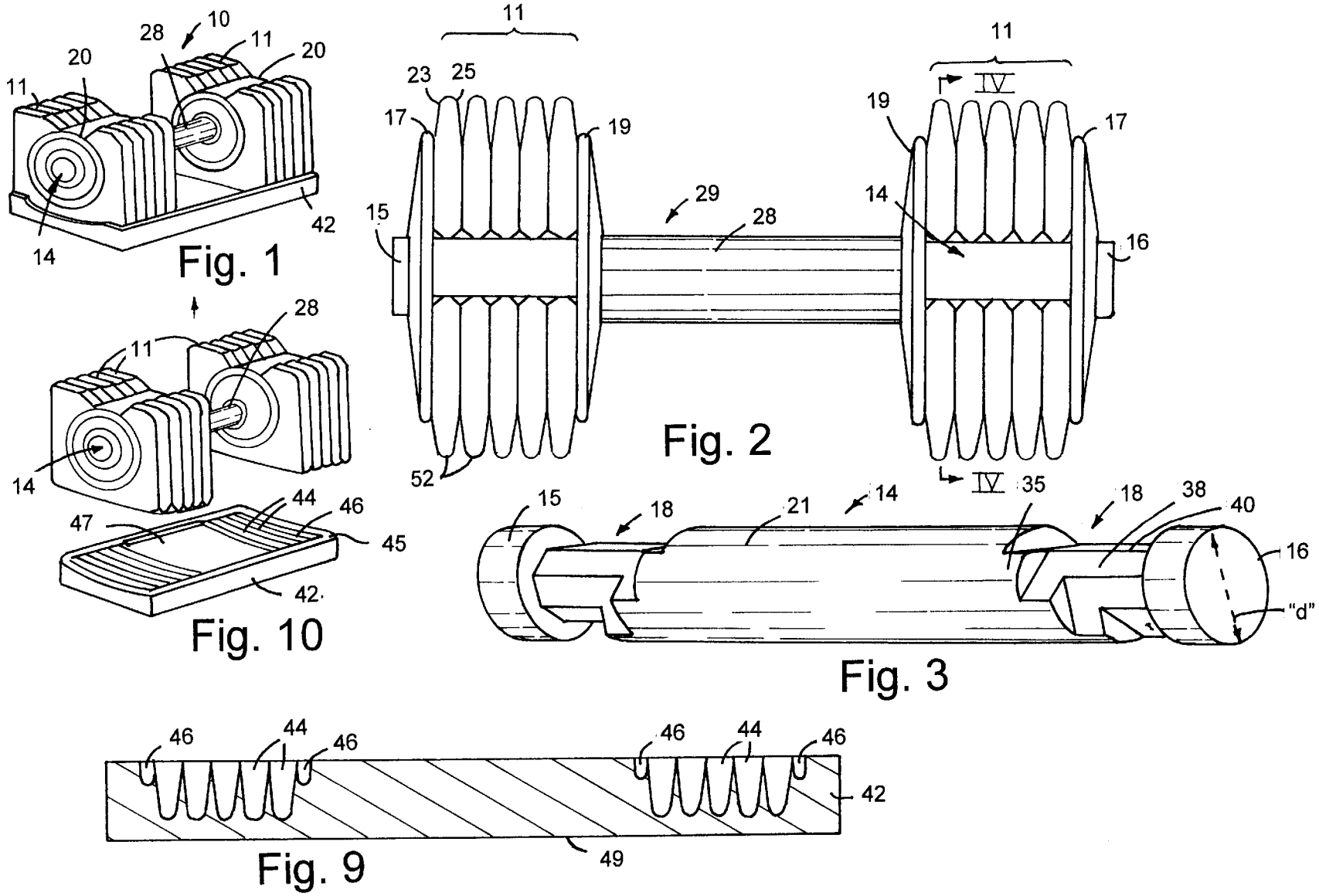
FIG. 1 is a perspective view of the weight-lifting apparatus of the instant invention.
FIG. 2 is a top view of the weight-lifting apparatus shown in FIG. 1.
FIG. 3 is a perspective view of the shaft of the weight-lifting apparatus of FIG. 1.
FIG. 9 is a cross-sectional front view of the holder of the weight-lifting apparatus of the instant invention.
FIG. 10 is a perspective view of the weight-lifting apparatus shown completely withdrawn from the holder.
Figure 4A:
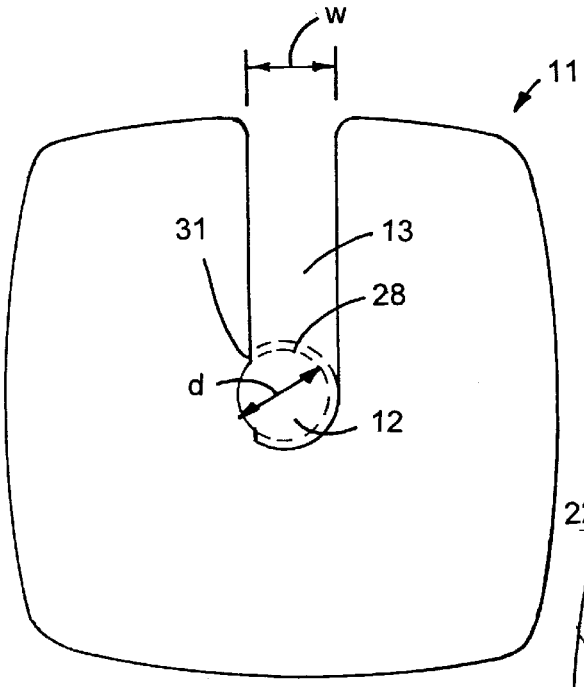
FIG. 4A is a side view of the weight shown in FIG. 4.
Figure 11:
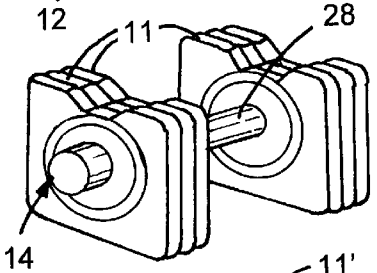
FIG. 11 is a perspective view similar to FIG. 10 showing only some of the weights withdrawn from the holder tray with the remaining weights stored in the holder.
Figure 11:
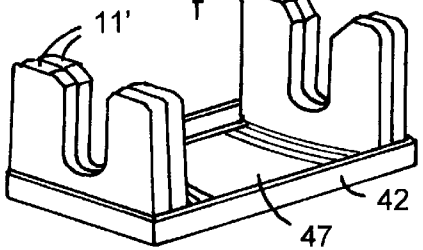

A weight-lifting apparatus 10 (FIG. 1) embodying the present invention includes a plurality of weights 11 each having a central hole 12 and a slot 13 extending from the central hole 12 to a perimeter of the associated weight 11 (FIG. 3). The apparatus 10 further includes a bar comprising a rotatable shaft 14 having opposing ends 15 and 16 and a sleeve 28 on the shaft 14 defining a diameter "d" about equal to the central holes 12. The shaft 14 rotatably engages the sleeve 28 and the central holes 12, and is rotatable to different positions. To store the weight, a holder or tray 42 is provided that is configured to store the weight-lifting apparatus 10 (FIG. 1) and also to store released weights when only some of the weights are being lifted by the shaft 14 (FIG. 11).

The shaft 14 (FIG. 4) has a plurality of machined recessed surfaces 18 around its outer surface that extend different longitudinal lengths on the opposing ends 15 and 16. The different lengths of the recessed surfaces 18 correspond to the different positions to which the shaft may be rotated. Preferably, the recessed surfaces 18 are about one-eighth inch deep into the surface of the shaft 14. The recessed surfaces 18 define with other surfaces on the shaft 14 a reduced dimension about equal to the width "w" of the slot 13. By rotating the shaft 14, the recessed surfaces 18 are selectively positionable to allow the shaft 14 to slide along one or more of the slots 13, thus selectively releasing the weights 11.

Figure 4:
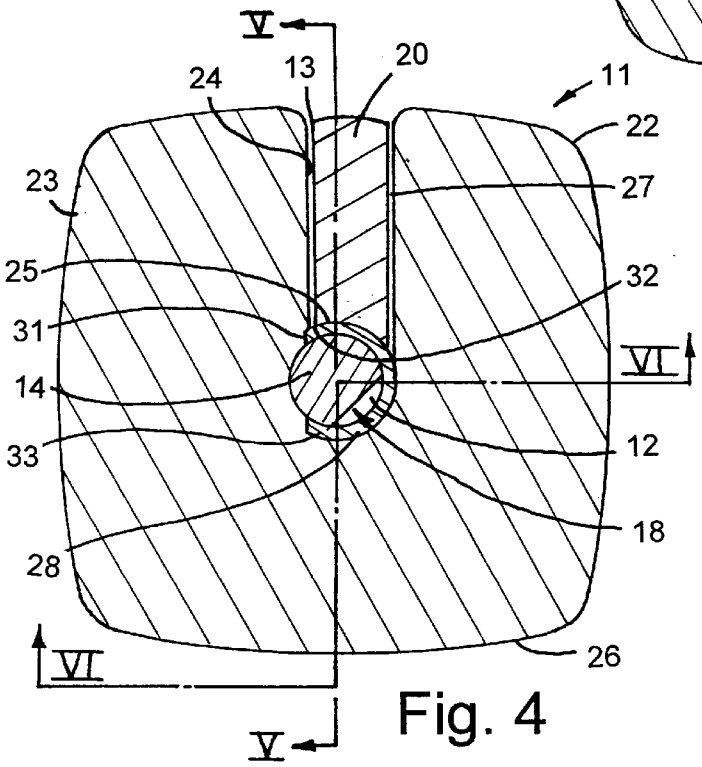
FIG. 4 is a cross-sectional view of the weight-lifting apparatus taken along line IV—IV of FIG. 2.

The shaft 14 is an elongated member made of structural material such as steel, and preferably is sized for one-handed use, i.e., as a dumbbell. Shaft 14 has an approximately circular cross section that rotatably fits the hole 12 of the weight plates 11 and is intended to be gripped around its center portion 21. Further, the recessed surfaces 18 get progressively longer from the ends 15, 16 toward the center of the shaft 14 (moving clockwise around the shaft when looking down the shaft from end 16). For example, surface 38 is shorter then surface 40. Depending upon the length of the surfaces 18, a different number of weight plates 11 will be released from the shaft 14. In particular, the longer the recessed surface 18, the more weight plates 11 that will be released from the shaft 14 when properly aligned in the hole 12 (described in further detail below). Further, as depicted in FIG. 4, the shaft 14 will release the outermost weight plates 11 first because those plates correspond to the recessed surface 18 with the shortest length. In a preferred form, as the shaft 14 is rotated to release or capture additional plates 11, the outermost plates are released first.

Figure 7:
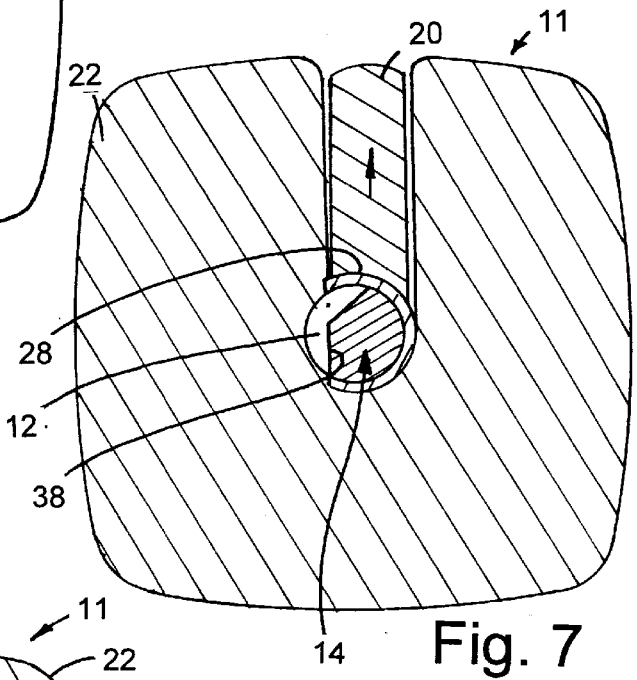
FIG. 7 is a cross-sectional view similar to FIG. 4 showing the shaft positioned to release a particular number of weight plates.
Figure 8:
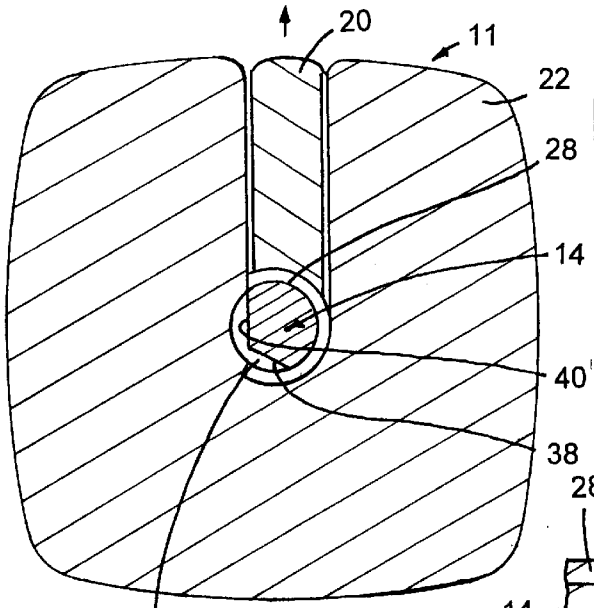
FIG. 8 is a cross-sectional view similar to FIG. 4 showing the shaft positioned to release a different number of weight plates.

As shown in FIGS. 1 and 4, the weights 11 are preferably square-shaped plates having rounded corners 22 for safety and a generally flat bottom surface 26 for sure storage in the holder 42 (described below). Further, the thickness of the weight plates will depend upon the material used for the plates, e.g., steel, and upon the desired weight. The faces 23 and 25 (FIG. 2) of the weight plates 11 are generally flat and abut against each other to minimize rattling of the weights when the weights are being lifted or when the weights are stored. In addition, as shown in FIGS. 4, 7 and 8, slot 13 of weight plates 11 is initially defined by the hole 12 which is located in the center of weight plates 11. The sides of the slot 13 are defined by a tangential side 27 and a second side 24 that is parallel to tangential side 27 but is spaced inboard from a tangential position relative to hole 12. The second side 24 and the hole 12 define an interference protrusion 31.

Figure 6:
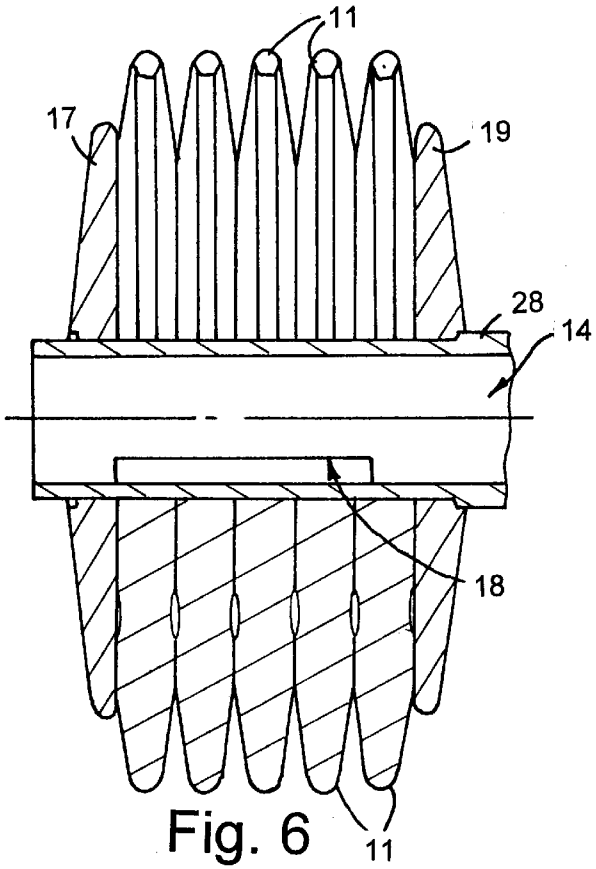
FIG. 6 is a cross-sectional view of the weight-lifting apparatus taken along line VI—VI of FIG. 4.
Figure 5:
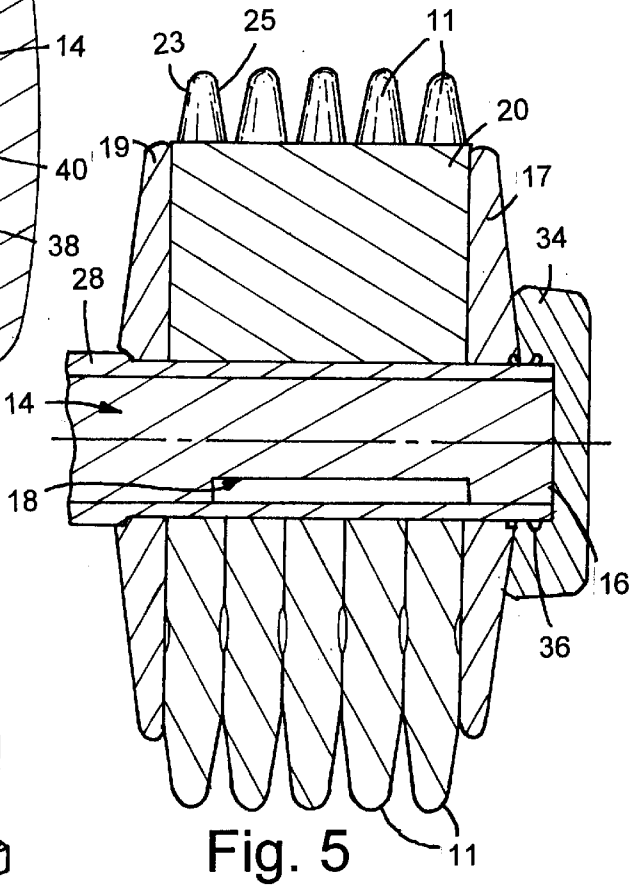
FIG. 5 is a partially broken away cross-sectional view taken along line V—V of FIG. 4.

In the preferred embodiment, apparatus 10 also includes a sleeve 28 that is positioned on shaft 14, extends the length of the shaft 14, and has a circular cross section except where the weights 11 are engaged (FIGS. 3, 5, 6). In that area, the cross section defines an incomplete circle. Together, the sleeve 28 and the shaft 14 comprise the bar of apparatus 10, which is the part of apparatus 10 which is intended to be gripped when lifting. As shown in FIGS. 2, 5 and 6, outer and inner stationary plates, 17 and 19 respectively, are attached to the sleeve 28 to prevent movement of weights 11 along the length of the shaft 14. Plates 17, 19 eliminate the need for a means to retain the plated weights, such as collars. In addition, to further stabilize weights 11, an alignment plate 20 is attached to an outer surface 29 of sleeve 28 and extends outwardly from surface 29 along the length of the sleeve 28 (FIGS. 4, 5 & 6). Alignment plate 20 has a thickness corresponding to the width "w" of the slots 13 of the weights 11 and, when particular weights are selected, occupies the space created by the slots 13 of the selected weights, thus adding weight to the apparatus and minimizing rotational movement of weight plates 11 when apparatus 10 is being lifted. Further, as the shaft 14 is rotated to select a desired number of weight plates 11, sleeve 28 remains stationary and properly aligned within the holes 12 of the weights so that the bar releases the selected weights 11.

To rotate the shaft 14, an adjustment knob 34 is fixedly attached to one end 16 of shaft 14 (FIG. 5). As the knob 34 is rotated, the shaft 14 correspondingly rotates to position the recessed surfaces 18 according to the desired amount of weight to be lifted, while the sleeve 28 remains stationary. To hold the shaft 14 in the selected position, the knob 34 is detented on the surface of stationary plate 17 at location 36. The detent may be any suitable detent such as a spring-loaded ball and socket detent configured to engage a series of corresponding receptacles (not shown). The detented positions of the knob 34 correspond to the number of weights 11 that may be selected, five on each end 15, 16 of the bar shown in FIGS. 2, 5 & 6. Preferably, to aid the user in selecting a weight, the knob 34 is marked with numbers or other indicia according to these detent positions to indicate the total weight that has been selected.

To lift a particular weight, the adjustment knob 34 is rotated to a desired detented position so that the corresponding recessed surface 18 of the shaft 14 is appropriately aligned in the hole 12 of the weight 11. If an outer surface (for instance, surface 35 in FIG. 3) of the shaft 14 engages the interference protrusion 31 of at least one of the weight plates 11, that weight plate 11 will be "locked" to the shaft 14 (FIG. 4). As a result, when the user lifts the apparatus 10, the locked weight 11 will be attached to the bar and be secure for lifting. Turning to FIG. 8, the shaft 14 is rotated to release at least one weight plate 11. In particular, a recessed surface 40 is positioned parallel and adjacent to the second side 24 of slot 13 such that the horizontal width of the shaft 14 in combination with the sleeve 28 is less than the width of the slot 13. Therefore, the shaft 14 will not engage the interference protrusion 31 when the apparatus 10 is lifted upwardly out of slot 13. As a result, the shaft 14 and sleeve 28 will slide within the slot 13 of the weight and separate from that weight.

In FIG. 7, the shaft 14 is rotated to capture and lock an additional weight plate 11. In particular, recessed surface 38 is aligned parallel and adjacent to the second side 24 of slot 13 to allow sliding movement of the shaft 14 within the slot 13 of the weight 11. Because recessed surface 38 is shorter than recessed surface 40 (the aligned surface shown in FIG. 8), an additional weight plate 11 will be locked to the shaft because an additional surface of shaft 14 (for instance, surface 35 in FIG. 3) will engage interference protrusion 31 of another weight 11 when the apparatus 10 is lifted. As the selected recessed surfaces 18 get shorter, the selected recessed surface 18 will operate to release different numbers of weights 11. The adjustment knob 34 can be selectively rotated to capture or release up to five weight plates 11, thus varying the weight to be lifted.

Note that the ends 32 and 33 of the sleeve 28 are always parallel and adjacent to the second side 24 of the slot 13 so that the sleeve 28, along with the shaft 14, will always slide in the slots 13 of the weight plates 11. Further, because the ends 32 and 33 of the incomplete circle-shaped sleeve 28 abut the second side 24 of slot 13, the support plate 20 prevents rotational movement of the weight 11 relative to the sleeve 28.

To store the dumbbell (i.e., to store the shaft 14 and knob 34, the sleeve 28, the stationary plates 17, 19 and the selected weight plates 11), the weight-lifting apparatus 10 includes a holder 42 that is preferably rectangular. The holder 42 has generally flat top and bottom surfaces, 47 and 49, respectively, and contains a series of depressions 44 corresponding to the shape of the outer rim 52 of the weight plates 11 (FIG. 2). In addition, holder 42 includes depressions 46 corresponding to the shape of stationary plates 17, 19. The top surface 47 of the holder 42 also includes a flat perimeter ledge 45 that prevents weights placed therein from sliding out from depressions 44.

When stored, the dumbbell, including the shaft 14 and plates 11 locked thereto, is securely retained in the holder 42 so that the dumbbell may be conveniently withdrawn from the holder 42 as shown in FIG. 10. In FIG. 11, the dumbbell is withdrawn from the holder and has only some of the weight plates 11 locked to its shaft 14, while some of the weight plates 11' remain stored in the holder 42 separate from the dumbbell. To insure that the plates 11' are securely maintained in the holder 42, the depressions 44 are sufficiently deep to prevent tipping of the plates 11'. To change the weight, the user replaces the dumbbell in the holder and rotates the adjustment knob to retrieve (or release) additional weights 11.

A method related to the above apparatus includes providing a weight-lifting apparatus 10 having a plurality of weights 11 and a shaft 14 shaped to selectively engage one or more of the weights 11, and rotating the shaft 14 to selectively engage a desired number of the weights 11. A person using the weight-lifting apparatus 10 can rotate the shaft 14 to select a new number of weights 11 and continue their exercise routine without interrupting their aerobic exercise routine to change weights.

In the preferred embodiment, the user rotates the shaft 14 by turning an adjustment knob 34 until a desired weight is selected. As mentioned previously, the knob 34 is detented, preferably to the stationary plate 17 of the weight-lifting apparatus 10, and is marked appropriately according to the number of weights that will be locked to the shaft 14 at any particular position. After rotating the knob 34 to select a desired lifting weight, the user grips the central portion of the sleeve 28 and lifts the dumbbell from the holder 42 to perform a particular exercise. If the user desires to adjust the weight from that which was originally selected, the user may return the dumbbell to the holder 42 and then rotate the adjustment knob 34 to the desired weight, thus selectively releasing or capturing weights 11. Because the weights 11 do not need to be retrieved or assembled onto the bar (14, 28), and no collars are required to retain the weight plates 11, nearly constant activity may be maintained and, therefore, the user can complete a workout, aerobic or anaerobic, in a minimum amount of time and with a minimum amount of inconvenience.

The above description is considered that of the preferred embodiments only. Modifications of the invention will occur to those skilled in the art and to those who make or use the invention. Therefore, it is understood that the embodiments shown in the drawings and described above are merely for illustrative purposes and not intended to limit the scope of the invention, which is defined by the following claims as interpreted according to the principles of patent law, including the doctrine of equivalents.

The invention claimed is:

1. A dumbbell comprising:

a plurality of paired weights, each of the paired weights having an axial hole and a transverse opening extending from the hole to a perimeter of the weight;

a bar including a rotatable shaft, the shaft rotatably engaging the holes of the paired weights; and means on the opposing ends of the shaft for engaging selected pairs of weights as the shaft is rotated between corresponding selected angular positions and for disengaging non-selected pairs of weights as the shaft is rotated between the selected angular positions by allowing the shaft travel out of the openings of non-selected pairs of weights.

2. The dumbbell defined in claim 1, including a holder configured to stably hold the plurality of paired weights when the shaft is being rotated, and configured to stably hold non-selected ones of the paired weights when the bar is lifted.

3. A weight-lifting apparatus comprising:

a plurality of weights each having a central hole and a slot extending from the central hole to a perimeter of the associated weight, the slot having a width less than the diameter of the central hole; and a bar including a rotatable shaft having opposing ends defining a diameter about equal to the central holes, the shaft rotatably engaging the central holes and being rotatable to different positions, the shaft further having a plurality of recessed surfaces that extend different longitudinal lengths on the opposing ends corresponding to the different positions, the recessed surfaces defining with other surfaces on the bar a reduced dimension about equal to the width of the slots, the shaft and the weights being configured so that, by rotating the shaft, selected weights are captured by the bar while the recessed surfaces allow the shaft to slide along the slots of non-selected weights to release the non-selected weights.

4. The weight-lifting apparatus defined in claim 3, wherein the bar includes a sleeve positioned on the shaft and sized to fit in the central holes of the weights, the sleeve having a cross section in an area adjacent the weights that is shaped to slip mateably through the slots.

5. The weight-lifting apparatus defined in claim 4, including an adjustment knob fixedly attached to one end of the shaft and rotatable relative to the weights, such that the knob may be rotated to selectively position the recessed surfaces with respect to the slots.

6. The weight-lifting apparatus defined in claim 5, wherein the sleeve has an alignment plate attached thereto, that extends radially outwardly from the sleeve and that engages the slots of the weights to maintain alignment of the weights.

7. The weight-lifting apparatus defined in claim 6, including stationary plates attached to the sleeve for preventing axial movement of the weights.

8. The weight-lifting apparatus defined in claim 7, wherein the adjustment knob is detented on one of the stationary plates for holding the shaft in a selected position.

9. The weight-lifting apparatus defined in claim 3, wherein the bar is generally cylindrical, has a central portion for gripping and has an outer surface.

10. The weight-lifting apparatus defined in claim 9, wherein the recessed surfaces are about one-eighth inch deep from an outer surface of the shaft.

11. The weight-lifting apparatus defined in claim 10, wherein the shaft is sized for one-handed use as a dumbbell.

12. The weight-lifting apparatus defined in claim 3, wherein the plurality of weights define a relatively square and flat shape having a plurality of rounded edges.

13. The weight-lifting apparatus defined in claim 12, wherein the plurality of weights are plates having a predetermined thickness.

14. The weight-lifting apparatus defined in claim 13, including a holder for retaining the plurality of weights and the shaft to which the weights are attached.

15. The weight-lifting apparatus defined in claim 14, wherein the holder contains a plurality of depressions corresponding to marginal edges of the weights.

16. The weight-lifting apparatus defined in claim 15, wherein the depressions retain individual weights independent of the shaft.

17. The weight-lifting apparatus defined in claim 3, wherein the recessed surfaces include first and second adjacent recessed surfaces having different longitudinal lengths, such that, by rotating the shaft from a position corresponding to the first recessed surface to a position corresponding to the second recessed surface adjacent thereto, the shaft selectively releases or captures one weight at either end.

18. A weight-lifting apparatus comprising:

a plurality of weights each having a central hole and a slot extending from the central hole to a perimeter of the associated weight, the slot having a width less than the diameter of the central hole and each having a plurality of perimeter edges;

a shaft having opposing ends defining a diameter about equal to the central holes, the shaft being shaped to rotatably engage the central holes and being rotatable to different positions, the shaft further having a plurality of recessed surfaces that extend different longitudinal lengths on the opposing ends corresponding to the different positions, the recessed surfaces defining a reduced dimension on the shaft, the shaft and the weights being configured so that, by rotating the shaft, selected weights are captured by the bar while the recessed surfaces allow the shaft to slide along the slots of non-selected weights thus releasing the non-selected weights;

a sleeve positioned on the shaft having a central portion for gripping and an alignment plate which prevents rotational movement of the selected weights relative to the shaft; and an adjustment knob for rotating the shaft, the knob being detented for holding the shaft in a selected position corresponding to a selected total weight.

19. The weight-lifting apparatus defined in claim 18, including a holder for storing the weights, the holder having depressions corresponding to the shape of the perimeter edges of the weights.

* * * * *